US011322268B2

(12) United States Patent
Sun et al.

(10) Patent No.: US 11,322,268 B2
(45) Date of Patent: May 3, 2022

(54) METHOD AND DEVICE FOR DISPOSING NUCLEAR WASTE USING DEEP GEOLOGICAL REPOSITORY

(71) Applicant: HARBIN QINGRUI SCIENCE AND TECHNOLOGY DEVELOPMENT CO., LTD., Harbin (CN)

(72) Inventors: Liyao Sun, Harbin (CN); Jinglan Han, Harbin (CN)

(73) Assignee: HARBIN QINGRUI SCIENCE AND TECHNOLOGY DEVELOPMENT CO., LTD., Harbin (CN)

( * ) Notice: Subject to any disclaimer, the term of this patent is extended or adjusted under 35 U.S.C. 154(b) by 1137 days.

(21) Appl. No.: 15/874,844

(22) Filed: Jan. 18, 2018

(65) Prior Publication Data

US 2019/0043629 A1 Feb. 7, 2019

Related U.S. Application Data

(63) Continuation of application No. PCT/CN2016/091669, filed on Jul. 26, 2016.

(30) Foreign Application Priority Data

Jul. 27, 2015 (CN) ..... 201510446371.7

(51) Int. Cl.
*G21F 9/24* (2006.01)
*G21F 9/16* (2006.01)

(52) U.S. Cl.
CPC ..... *G21F 9/24* (2013.01); *G21F 9/16* (2013.01); *G21F 9/165* (2013.01)

(58) Field of Classification Search
CPC ..... G21F 9/24; G21F 9/16; G21F 9/165
See application file for complete search history.

(56) References Cited

U.S. PATENT DOCUMENTS 3,058,521 A * 10/1962 Gilbert ..... E21B 43/26 166/308.2
3,108,439 A * 10/1963 Reynolds ..... G21F 9/24 588/17

(Continued)

FOREIGN PATENT DOCUMENTS

CN 2447517 Y 9/2001
CN 101434836 A 5/2009

(Continued)

OTHER PUBLICATIONS

"Chinese Application No. 201510446371.7, First Office Action dated Dec. 2, 2016", (dated Dec. 2, 2016), 5 pgs.

(Continued)

*Primary Examiner* — Janine M Kreck
(74) *Attorney, Agent, or Firm* — Schwegman Lundberg & Woessner, P.A.

(57) ABSTRACT

A disposal device comprises a raw material conveyor, a raw material mixer, a liquid waste conveying pipeline, an additive tank, a powder waste conveyor, an output pump, a liquid supply pump, a liquid supply manifold, an output manifold, a mixed liquid conveying pipeline, a high-pressure injection pump, a high-pressure pipeline, and a wellhead sealing device. A method of employing the device includes: drilling a well; forming a fracture in the granite stratum; preparing a raw material; and injecting, by using the disposal device, a sand-carrying feed liquid from a high-pressure injection pump into the fracture of the underground granite stratum, so as to perform solidification.

13 Claims, 3 Drawing Sheets

(56) References Cited

U.S. PATENT DOCUMENTS

| | | | | |
|---|---|---|---|---|
| 3,262,274 | A * | 7/1966 | Nelson, Jr. | G21F 9/24 588/3 |
| 3,513,100 | A * | 5/1970 | Stogner | G21F 9/24 588/3 |
| 5,007,590 | A | 4/1991 | Taylor | |
| 5,133,624 | A * | 7/1992 | Cahill | B09B 1/008 166/308.1 |
| 5,245,118 | A * | 9/1993 | Cole, Jr. | B09B 1/002 405/129.35 |
| 5,986,159 | A | 11/1999 | Aines et al. | |
| 6,382,423 | B1 | 5/2002 | Bush | |
| 2014/0221722 | A1* | 8/2014 | Germanovich | G21F 9/24 588/17 |
| 2021/0304913 | A1 | 9/2021 | Sun et al. | |

FOREIGN PATENT DOCUMENTS

| | | | |
|---|---|---|---|
| CN | 103233715 | A | 8/2013 |
| CN | 203448043 | U | 2/2014 |
| CN | 103814411 | A | 5/2014 |
| CN | 103922681 | A | 7/2014 |
| CN | 105070339 | A | 11/2015 |
| CN | 204857203 | U | 12/2015 |
| WO | WO-2017016466 | A1 | 2/2017 |

OTHER PUBLICATIONS

"Chinese Application No. 201510446371.7, Notification to Grant Patent Right for Invention", (dated Mar. 31, 2017), 2 pgs.

"Chinese Application No. 201510446371.7, Search Report dated Oct. 27, 2016", (dated Oct. 27, 2016), 1 pg.

"International Application No. PCT/CN2016/091669, International Preliminary Report on Patentability dated Jan. 30, 2018", (dated Jan. 30, 2018), 8 pgs.

"International Application No. PCT/CN2016/091669, International Search Report and Written Opinion dated Nov. 3, 2016", (dated Nov. 3, 2016), 9 pgs.

* cited by examiner

METHOD AND DEVICE FOR DISPOSING NUCLEAR WASTE USING DEEP GEOLOGICAL REPOSITORY

CROSS REFERENCE TO RELATED APPLICATIONS

This application is a continuation of PCT/CN2016/091669 filed Jul. 26, 2016, which claims priority to CN 201510446371.7 filed Jul. 27, 2015 both of which are incorporated herein by reference.

BACKGROUND OF THE INVENTION

1. Technical Field

The present invention relates to methods and apparatuses for disposal of nuclear waste. More particularly, it relates to a method and a device for disposing nuclear waste using a deep geological repository.

2. Description of Related Art

Disposal of nuclear waste has become a huge challenge to nations all over the world, including developed countries. In China, the cumulative amount of nuclear waste liquid has reached tens of thousands of cubic meters (not including solid nuclear waste). With the 400 tons of nuclear waste generated every year in our nuclear power plants, tens of thousands of tons of waste will be added to the cumulative amount by 2020. It is estimated that China will have more than 83,000 tons of nuclear waste in 60 years. This number is even higher than the total nuclear spent fuel of the United States. According to historical records, China has begun to search after geological disposal of nuclear waste since 1986. However, there has been no substantive breakthrough to date. Nuclear waste can be classified by its physical states, and includes three types, namely solid waste, liquid waste, and gaseous waste. Nuclear waste can also be classified by its levels of specific activity, and includes high-level activity, intermediate-level activity, and low-level activity. The strongly radioactive nuclear waste with high-level activity that is extremely harmful to people only takes 1% of the total amount of nuclear waste, so its disposal is not discussed herein. There are two ways to powder nuclear waste. One is high-pressure grinding, and the other is mechanical pulverization with a pulverized particle size between 0.45 to 0.9 mm. Currently, nuclear waste is usually disposed using the following ways: I. storing under the seabed; II. freezing; III. storing in shallow buried districts; IV. storing in the astrospace; V. storing in ground sarcophagus; and VI. storing in deep geological repositories or deep holes. These known approaches, however, have the following problems. As to storage under the seabed, contamination of the sea water is unavoidable when the waste is poured into oceanic trenches. In the case of freezing, the frozen nuclear waste is packed in containers and placed into the permafrost in the Arctic Ocean or in other seas. Then the nuclear waste uses its own heat to melt the ice and sinks below the ice, but it is after all present in the sea. Transporting nuclear waste to the astrospace is to date an unimplemented idea from scientists because the consequence of rocket launching fail is underestimatable. While storage of nuclear waste in shallow buried districts involves costly solidification of nuclear waste and dangerous human operation, this is a worldwide recognizable method, and China will not be capable of building such facilities until 2030. With regard to ground sarcophagus, it is actually some thick cement planks covering nuclear waste from above, and this is what used in the Chernobyl Nuclear Power Plant. The last method is to keep nuclear waste in deep geological repositories or deep holes. Whereas deeply drilled holes are limited in volume, deep geological repositories are more capacious and extensively recognized as an effective way to store nuclear waste. This method can be implemented using proper apparatuses and operations without staff involvement, and has the potential to treat more than ten thousands of cubic meters of nuclear waste at the same time for permanent underground storage. At present, there have not been any reports about this disposal method and related apparatuses.

SUMMARY OF THE INVENTION

In order to solve the problems about the existing nuclear waste disposal practices such as high costs, insecurity, and health hazard to related workers, the present invention provides a method and a device for disposing nuclear waste using a deep geological repository by adopting the following technical schemes.

A device for disposing nuclear waste using a deep geological repository comprises a raw material conveyor, a raw material mixer, a liquid waste conveying pipeline, an additive tank, a powder waste conveyor, an output pump, a liquid supply pump, a liquid supply manifold, an output manifold, a mixed liquid conveying pipeline, a high-pressure injection pump, a high-pressure pipeline, a wellhead sealing device, a supply-discharge pump connecting pipe, a first valve, and a second valve. The device is characterized in that: the raw material conveyor is arranged at the left side of the raw material mixer, the raw material conveyor has an output end thereof communicated with a top of the raw material mixer, the liquid waste conveying pipeline has an output end thereof communicated with an upper part of the raw material mixer, the liquid waste conveying pipeline has an input end thereof connected to a liquid waste source, the additive tank is deposited above the raw material mixer, the additive tank has a lower end thereof communicated with the top of the raw material mixer, the powder waste conveyor has an output end thereof communicated with an upper part of the raw material mixer, the liquid supply pump has an input end thereof connected to the liquid supply manifold, the liquid supply pump has an output end thereof connected to the raw material mixer, the output pump has an input end thereof connected to the raw material mixer, the supply-discharge pump connecting pipe is arranged between an output pipeline of the liquid supply pump and an input pipeline of the output pump, the first valve is located on the output pipeline of the liquid supply pump at the left side of the supply-discharge pump connecting pipe, the second valve is located on the supply-discharge pump connecting pipe, the output pump has an output end thereof connected to an input end of the output manifold, the output manifold has an output end thereof connected to an input end of the mixed liquid conveying pipeline, the mixed liquid conveying pipeline has an output end thereof connected to an input end of the high-pressure injection pump, the high-pressure injection pump has an output end thereof connected to an input end of the high-pressure pipeline, and the wellhead sealing device is located at a terminal of the high-pressure pipeline.

The method for disposing nuclear waste using a deep geological repository of the present invention comprises the following steps:

Step I. drilling a well down to the granite stratum;

Step II. forming a fracture in the granite stratum using the foregoing device by injecting liquid into the underground granite stratum through the liquid supply manifold of the device, the liquid supply pump, the supply-discharge pump connecting pipe, the output pump, the output manifold, the mixed liquid material conveying pipeline, the high-pressure injection pump, the high-pressure pipeline and a conveying pipeline in the well, with the high-pressure injection pump set at 40 to 140 MPa/cm$^2$, so as to form the fracture in the granite stratum, wherein during this step the first valve is closed and the second valve on the supply-discharge pump connecting pipe is opened;

Step III. after Step II of forming fracture is completed, weighing 2 to 4 parts of polyacrylamide, 45 to 55 parts of cementing cement, 1.5 to 2.5 parts of a profile control agent, 2 to 8 parts of quartz sand, 0.5 to 1.5 parts of a high-temperature resistant reagent, 20 to 30 parts of a radioactive substance, 0.5 to 5 parts of a cement retardant or 2 to 5 parts of a coagulant, and 30 to 60 parts of water;

Step IV. using the device, sending the quartz sand and the cementing cement of Step III through the raw material conveyor of the device to the raw material mixer of the device, sending the radioactive substance (nuclear waste) through the powder waste conveyor or the liquid waste conveying pipeline to the raw material mixer of the device, sending the profile control agent, the high-temperature resistant reagent, the cement retardant, and the coagulant through the additive tank of the device to the raw material mixer, sending the water through the liquid supply manifold by the liquid supply pump to the raw material mixer, and mixing uniformly to form a sand-carrying feed liquid, wherein during this step, the first valve is opened, and the second valve on the supply-discharge pump connecting pipe is closed;

Step V. sending the sand-carrying feed liquid mixed in the Step IV by the output pump of the device to the output manifold and then to the mixed liquid material conveying pipeline through the output manifold; and Step VI. injecting the sand-carrying feed liquid in the mixed liquid material conveying pipeline in Step V to the fracture in the underground granite stratum by the high-pressure injection pump through the high-pressure pipeline, and the conveying pipeline in the well, with the injection pressure of the high-pressure injection pump set at 30 to 70 MPa, so that water in the fracture of the granite stratum expands in a horizontal direction of the stratum under the effect of the pressure of the sand-carrying feed liquid, and the sand-carrying feed liquid stays in the fracture of the granite stratum for solidification, and after disposal the wellhead is sealed by wellhead cementing concrete, thereby permanently storing the nuclear waste in the fracture of the underground granite stratum and achieving the purpose of effective disposal to the nuclear waste.

The disclosed method and device for disposing nuclear waste using a deep geological repository of the present invention require no anti-nuclear radiation measures, and the device is compressed and buried after one-time use. The device only requires automated control and robotic operation, and thus eliminated the problem about possible radioactive hazard to workers. Disposal using the present invention has the advantages of a low cost, simple device structure, high practicability, and high disposal efficiency. The disclosed method can dispose ten thousands of cubic meters of nuclear waste and store them permanently underground with only one hundredth or thousandth cost as compared to the prior art. Moreover, it is safe and reliable, and effectively reduces contamination and hazards to the environment caused by nuclear waste. The present invention is applicable to both powder nuclear waste and liquid nuclear waste.

BRIEF DESCRIPTION OF THE DRAWINGS

In FIG. 2, 18 denotes the conveying pump connecting end of the powder waste conveyor.

In FIG. 3, 20 represents the ground layer; 21 represents the conveying column; 22 represents a rock stratum; 24 represents the granite stratum; and 25 represents the gelatinized nuclear waste.

DETAILED DESCRIPTION OF THE INVENTION

Embodiment I

Figure 1:
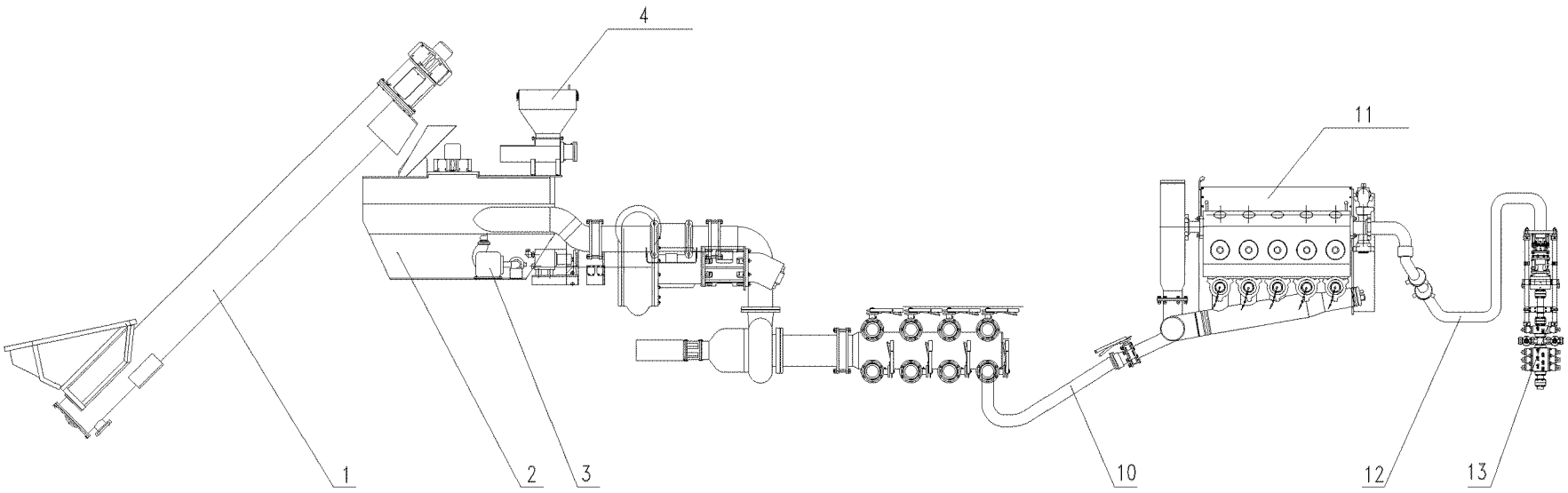
FIG. 1 is a schematic structure drawing of the device of the present invention.
Figure 2:
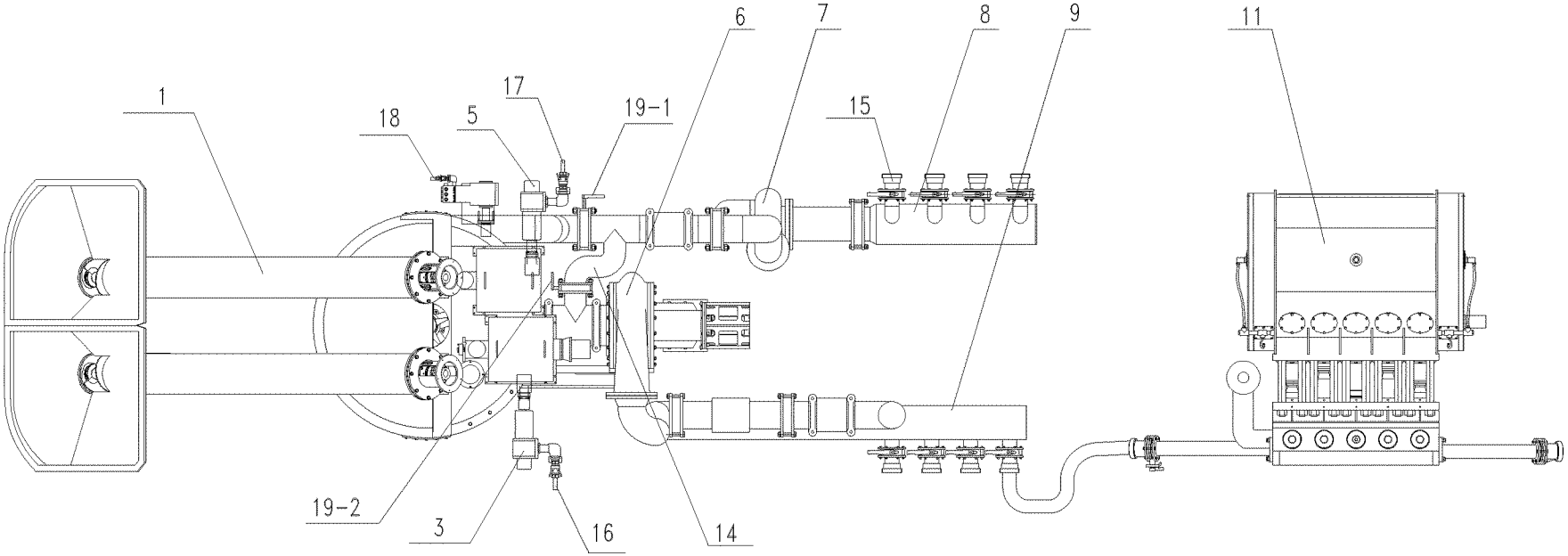
FIG. 2 is a top view of the device of FIG. 1.
Figure 3:
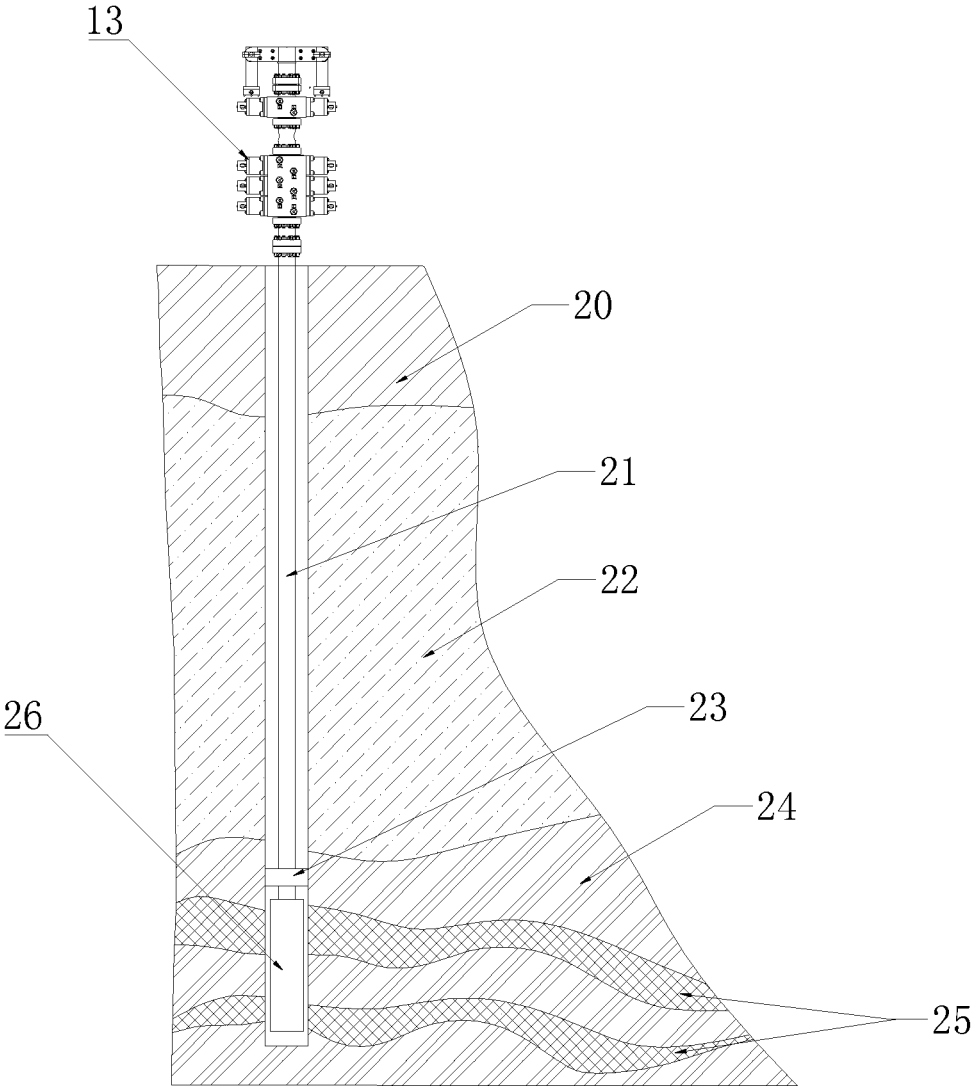
FIG. 3 is a schematic drawing of the pipeline in the well and sand-carrying feed liquid solidified in a fracture of the granite stratum.

As shown in FIG. 1 and FIG. 2, the device of the present embodiment comprises:

a raw material conveyor 1 for sending fracture-forming sand and wellhead cementing concrete to a mixer described below, a fracture-forming liquid and gel raw material mixer 2 for mixing and stirring gel materials, a liquid waste conveying pump 3 for delivering liquid nuclear waste into the raw material mixer, an additive tank 4 for feeding additives into the raw material mixer 2, a powder waste conveyor 5 for delivering powder nuclear waste into the raw material mixer, an output pump 6 for sending the fracture-forming liquid and the gel mixture to the high-pressure injection pump, a liquid supply pump 7 for sending liquid materials required for the fracture-forming liquid and the gel mixture into the raw material mixer, a liquid supply manifold 8 for sending various kinds of liquid required in the process to the liquid supply pump, an output manifold 9 for outputting the mixed fracture-forming liquid and the gel mixture to the high-pressure injection pump, a mixed liquid conveying pipeline 10, a high-pressure injection pump 11 for injecting the fracture-forming liquid and the gel mixture into the granite stratum, a high-pressure pipeline 12, a wellhead sealing device 13, and a supply-discharge pump connecting pipe 14.

The raw material conveyor 1 is arranged at the left side of the raw material mixer 2. The raw material conveyor 1 has its output end communicated with the top of the raw material mixer 2. The liquid waste conveying pipeline 3 has its output end communicated with the upper part of the raw material mixer 2. Multiple liquid waste conveying pipelines 3 may be designed depending on the amount of the input liquid nuclear waste. The liquid waste conveying pipeline 3 has its input end connected to the liquid waste source. The additive tank 4 is located above the raw material mixer 2. The additive tank 4 has its lower end communicated with the top of the raw material mixer 2. The powder waste conveyor 5 has its input end connected to the nuclear waste truck. The powder waste conveyor 5 has its output end communicated with the upper part of the raw material mixer 2. The liquid supply pump 7 has its input end connected to the liquid supply manifold 8. The liquid supply pump 7 has its output end connected to the raw material mixer 2. The output pump 6 has its input end connected to the raw material mixer 2. The supply-discharge pump connecting pipe 14 is located between the output pipeline of the liquid supply pump 7 and the input pipeline of the output pump 6. A first valve 19-1 is arranged on the output pipeline of the liquid supply pump 7 at the left side of the supply-discharge pump connecting pipe 14, and a second valve 19-2 is arranged on the supply-discharge pump connecting pipe 14. The output pump 6 has its output end connected to the input end of the output manifold 9. The output manifold 9 has its output end connected to the input end of the mixed liquid conveying pipeline 10. The mixed liquid conveying pipeline 10 has its output end connected to the input end of the high-pressure injection pump 11. The high-pressure injection pump 11 has its output end connected to the input end of the high-pressure pipeline 12. A wellhead sealing device 13 is arranged at the terminal of the high-pressure pipeline 12. The wellhead sealing device 13 uses a full-sealing, semi-sealing or self-sealing blowout-preventing gate. The high-pressure pipeline 12 has its terminal communicated with a conveying pipeline in the well.

Embodiment II

As shown in FIG. 1 and FIG. 2, in the present embodiment, the liquid supply manifold 8 is provided with a liquid supply hole 15 that is connected to a liquid source through a pipeline.

Embodiment III

As shown in FIG. 1 and FIG. 2, in the present embodiment, the raw material conveyor 1 and the powder waste conveyor 5 are each a screw-type conveyor.

Embodiment IV

As shown in FIG. 1 and FIG. 2, in the present embodiment, the powder waste conveyor 5 and the liquid waste conveying pipeline 3 have their input ends connected to the conveying pump connecting end 17 and the conveying pump connecting end 16, respectively.

Embodiment V

As shown in FIG. 1 and FIG. 2, in the present embodiment, the device is a vehicle-mounted type for convenient mobilization, and the power source is a diesel engine, while the high-pressure injection pump is driven by a shaft.

Embodiment VI

In the present embodiment, the method for disposing nuclear waste using a deep geological repository comprises the following steps:

Step I. drilling a well down to the granite stratum and sampling the granite stratum;

Step II. forming a fracture in the granite stratum using the device by injecting liquid into the underground granite stratum through the liquid supply manifold 8 of the device, the liquid supply pump 7, the supply-discharge pump connecting pipe 14, the output pump 6, the output manifold 9, the mixed liquid material conveying pipeline 10, the high-pressure injection pump 11, the high-pressure pipeline 12 and a conveying pipeline in the well, with the high-pressure injection pump 11 set at 40 to 140 MPa/cm$^2$, so as to form the fracture in the granite stratum, wherein the pressure is set according to the density of the granite stratum, and during this step the first valve is closed and the second valve on the supply-discharge pump connecting pipe is opened;

Step III. weighing 2 to 4 parts of polyacrylamide, 45 to 55 parts of cementing cement, 1.5 to 2.5 parts of a profile control agent, 2 to 8 parts of quartz sand, 0.5 to 1.5 parts of a high-temperature resistant reagent, 20 to 30 parts of a radioactive substance (the nuclear waste), 0.5 to 5 parts of a cement retardant (for prolonging the coagulating time) or 2 to 5 parts of a coagulant (for shortening the coagulating time), and 30 to 60 parts of water;

Step IV. using the foregoing disposal device, sending the quartz sand and the cementing cement of Step III through the raw material conveyor 1 of the device to the raw material mixer 2 of the device, sending the radioactive substance (the nuclear waste) through the powder waste conveyor 5 or the liquid waste conveying pipeline 3 to the raw material mixer 2 of the device, sending the profile control agent, the high-temperature resistant reagent, the cement retardant, and the coagulant through the additive tank 4 of the device to the raw material mixer 2, and sending liquid through the liquid supply manifold 8 by the liquid supply pump 7 to the raw material mixer 2 and mixing uniformly, wherein during this step the first valve 19-1 is opened, and the second valve 19-2 on the supply-discharge pump connecting pipe 14 is closed;

Step V. sending the sand-carrying feed liquid mixed in Step IV by the output pump 6 of the device to the output manifold 9, and then to the mixed liquid material conveying pipeline 10 through the output manifold 9;

Step VI. injecting the sand-carrying feed liquid in the mixed liquid material conveying pipeline 10 in Step V to the fracture in the underground granite stratum by the high-pressure injection pump 11 through the high-pressure pipeline 12 and a conveying pipeline in the well, wherein the injection pressure of the high-pressure injection pump 11 is 30 to 70 MPa, so that water in the fracture of the granite stratum expands in a horizontal direction of the stratum under the effect of the pressure of the sand-carrying feed liquid, and the sand-carrying feed liquid stays in the fracture of the granite stratum for solidification, and after disposal the wellhead is sealed by wellhead cementing concrete, thereby permanently storing the nuclear waste in the fracture of the underground granite stratum, and achieving the purpose of effective disposal to the nuclear waste.

Embodiment VII

Different from Embodiment VI, the present embodiment has an active agent added into the fracture-forming liquid in Step II, wherein the active agent is composed of a surfactant and oxalic acid in a ratio of 4.5 to 5:1 to 1.5%, and the surfactant is linear alkylbenzene sulfonate, tetrapropylene benzene sulfonate, dioctyl sulfosuccinate, sodium dodecyl benzene sulfonate, or sodium stearyl sulfate. The adding amount of the active agent is 2 to 3.5% of the water. The fracture-forming liquid containing the active agent is named as an active water, whose functions are lowering the surface tension of the fracture-forming liquid and promoting moistness, permeation and dispersedness.

Embodiment VIII

The present embodiment provides further limitations to Embodiment VI by specifying that when the nuclear waste in Step III is powder waste, the liquid waste conveying pipeline 3 of the device is closed; and when the nuclear waste is liquid waste, the powder waste conveyor 5 of the device is closed.

Embodiment IX

Different from Embodiment VI, in the present embodiment, weighing in Step III includes weighing 3 parts of polyacrylamide, 50 parts of cementing cement, 2 parts of the profile control agent, 5 parts of the quartz sand, 1 part of the high-temperature resistant reagent, 25 parts of the radioactive substance (the nuclear waste), 3 parts of the cement retardant (for prolonging the coagulating time) or 3.5 parts of the coagulant (for shortening the coagulating time) and 45 parts of water, and in Step VI the injection pressure of the high-pressure injection pump 11 is 50 MPa.

Embodiment X

In the present embodiment, the profile control agent serves to enhance resistance to high temperature and high pressure and improve the stability of concrete.

Embodiment XI

In the present embodiment, the profile control agent, the high-temperature resistant reagent, the cement retardant and the coagulant are all preparations usually used in cement applications.

Embodiment XII

In the present embodiment, the packer 23 is a rubber-metal structure packer 23 that is usually used for hydraulic fracturing in petroleum applications, and the spray applicator 26 is a spray applicator 26 that is usually used for hydraulic fracturing in petroleum applications.

In the present invention, the device is made of high-pressure steel.

In the present invention, remote computer-assisted automated control and robotic operation are sufficient to operate the device.

The ratio of the added polyacrylate ammonium, quartz sand, chemical additives, wellhead cementing cement and liquid to the nuclear waste is 10 cubic meters: 1 cubic meter.

The present invention has been described with reference to the preferred embodiments and it is understood that the embodiments are not intended to limit the scope of the present invention. Moreover, as the contents disclosed herein should be readily understood and can be implemented by a person skilled in the art, all equivalent changes or modifications which do not depart from the concept of the present invention should be encompassed by the appended claims.

What is claimed is:

1. A method for disposing nuclear waste using a deep geological repository, comprising the following steps:

drilling a well down to a granite stratum;

forming a fracture in the granite stratum by injecting liquid for forming fracture into the underground granite stratum;

injecting a sand-carrying feed liquid containing powder nuclear waste or liquid nuclear waste to the fracture in the underground granite stratum by a high-pressure injection pump, so that the sand-carrying feed liquid stays in the fracture of the granite stratum for coagulating, and after disposal a wellhead is sealed by wellhead cementing concrete, thereby permanently storing the nuclear waste in the fracture of the underground granite stratum, and achieving the purpose of effective disposal to the nuclear waste; and adding an active agent into the liquid for forming fracture, wherein the active agent is composed of a surfactant and oxalic acid in a ratio of 4.5 to 5:1, in which the surfactant is linear alkylbenzene sulfonates, tetrapropylene benzene sulfonate, dioctyl sulfosuccinate, sodium dodecyl benzene sulfonate or sodium stearyl sulfate, and the active agent is added in an amount equal to 2 to 3.5% of water in the liquid.

2. The method for disposing nuclear waste using a deep geological repository of claim 1, further comprising the following steps:

sampling the granite stratum; and forming the fracture in the granite stratum, wherein the pressure is set according to the density of the granite stratum, and the pressure is set at 40 to 140 MPa/cm$^2$.

3. A method for disposing nuclear waste using a deep geological repository, comprising the following steps:

drilling a well down to a granite stratum;

forming a fracture in the granite stratum by injecting liquid for forming fracture into the underground granite stratum; and injecting a sand-carrying feed liquid containing powder nuclear waste or liquid nuclear waste to the fracture in the underground granite stratum by a high-pressure injection pump, so that the sand-carrying feed liquid stays in the fracture of the granite stratum for coagulating, and after disposal a wellhead is sealed by wellhead cementing concrete, thereby permanently storing the nuclear waste in the fracture of the underground granite stratum, and achieving the purpose of effective disposal to the nuclear waste; and weighing and mixing the following substances to form the sand-carrying feed liquid: 2 to 4 parts of polyacrylamide, 45 to 55 parts of cementing cement, 1.5 to 2.5 parts of a profile control agent, 2 to 8 parts of quartz sand, 0.5 to 1.5 parts of a high-temperature resistant reagent, 20 to 30 parts of a nuclear waste, 0.5 to 5 parts of a cement retardant for prolonging the coagulating time or 2 to 5 parts of a coagulant for shortening the coagulating time, and 30 to 60 parts of water.

4. The method for disposing nuclear waste using a deep geological repository of claim 1, wherein the method requires a remote computer-assisted automated control and a robotic operation.

5. The method for disposing nuclear waste using a deep geological repository of claim 3, further comprising the following step:

adding an active agent into the liquid for forming fracture, wherein the active agent is composed of a surfactant and oxalic acid in a ratio of 4.5 to 5:1, in which the surfactant is linear alkylbenzene sulfonates, tetrapropylene benzene sulfonate, dioctyl sulfosuccinate, sodium dodecyl benzene sulfonate or sodium stearyl sulfate, and the active agent is added in an amount equal to 2 to 3.5% of water in the liquid.

6. The method for disposing nuclear waste using a deep geological repository of claim 5, further comprising the following step:

injecting the sand-carrying feed liquid to the fracture in the underground granite stratum by the high-pressure injection pump through a high-pressure pipeline and a conveying pipeline in the well, wherein the injection pressure of the high-pressure injection pump is set at 30 to 70 MPa, so that water in the fracture of the granite stratum expands in a horizontal direction of the stratum under the effect of the pressure of the sand-carrying feed liquid.

7. A method for disposing nuclear waste using a deep geological repository, comprising the following steps:

Step I. drilling a well down to a granite stratum;

Step II. forming a fracture in the granite stratum using a device by injecting liquid into the underground granite stratum through a liquid supply manifold of a disposal device, a liquid supply pump, a supply-discharge pump connecting pipe, a output pump, a output manifold, a mixed liquid material conveying pipeline, a high-pressure injection pump, a high-pressure pipeline and a conveying pipeline in the well, with the high-pressure injection pump set at 40 to 140 MPa/cm$^2$, so as to form the fracture in the granite stratum, wherein during this step a first valve is closed and a second valve on the supply-discharge pump connecting pipe is opened;

Step III. weighing 2 to 4 parts of polyacrylamide, 45 to 55 parts of cementing cement, 1.5 to 2.5 parts of a profile control agent, 2 to 8 parts of quartz sand, 0.5 to 1.5 parts of a high-temperature resistant reagent, 20 to 30 parts of a radioactive substance, 0.5 to 5 parts of a cement retardant or 2 to 5 parts of a coagulant, and 30 to 60 parts of water;

Step IV. using the device, sending the quartz sand and the cementing cement of Step III through a raw material conveyor of the device to a raw material mixer of the device, sending the radioactive substance through a powder waste conveyor or the liquid waste conveying pipeline to the raw material mixer of the device, sending the profile control agent, the high-temperature resistant reagent, the cement retardant, and the coagulant through the additive tank of the device to the raw material mixer, sending the water through the liquid supply manifold by the liquid supply pump to the raw material mixer, and mixing uniformly, wherein during this step, the first valve is opened, and the second valve on the supply-discharge pump connecting pipe is closed;

Step V. sending the sand-carrying feed liquid mixed in Step IV by the output pump of the device to the output manifold and then to the mixed liquid material conveying pipeline through the output manifold; and Step VI. injecting the sand-carrying feed liquid in the mixed liquid material conveying pipeline in Step V to the fracture in the underground granite stratum by the high-pressure injection pump through the high-pressure pipeline and the conveying pipeline in the well, with the injection pressure of the high-pressure injection pump set at 30 to 70 MPa, so that water in the fracture of the granite stratum expands in a horizontal direction of the stratum under the effect of the pressure of the sand-carrying feed liquid, and the sand-carrying feed liquid stays in the fracture of the granite stratum for coagulating, and after disposal the wellhead is sealed by wellhead cementing concrete, thereby permanently storing the nuclear waste in the fracture of the underground granite stratum, and achieving the purpose of effective disposal to the nuclear waste.

8. The method for disposing nuclear waste using a deep geological repository of claim 7, further comprising adding an active agent into the fracture-forming liquid of Step II, wherein the active agent is composed of a surfactant and oxalic acid in a ratio of 4.5 to 5:1, in which the surfactant is linear alkylbenzene sulfonates, tetrapropylene benzene sulfonate, dioctyl sulfosuccinate, sodium dodecyl benzene sulfonate or sodium stearyl sulfate, and the active agent is added in an amount equal to 2 to 3.5% of the water.

9. The method for disposing nuclear waste using a deep geological repository of claim 7, wherein, in Step III, when the nuclear waste is powder waste, the liquid waste conveying pipeline of the device is closed, and when the nuclear waste is liquid waste, the powder waste conveyor of the device is closed.

10. The method for disposing nuclear waste using a deep geological repository of claim 7, wherein, in Step III, the weighing includes weighing 3 parts of polyacrylamide, 50 parts of the cementing cement, 2 parts of the profile control agent, 5 parts of the quartz sand, 1 part of the high-temperature resistant reagent, 25 parts of the radioactive substance, 3 parts of the cement retardant or 3.5 parts of the coagulant, and 45 parts of the water; and in Step VI, the injection pressure of the high-pressure injection pump is 50 MPa.

11. The method for disposing nuclear waste using a deep geological repository of claim 7, wherein the profile control agent, the high-temperature resistant reagent, the cement retardant and the coagulant are all preparations usually used in cement applications.

12. The method for disposing nuclear waste using a deep geological repository of claim 7, further comprising the steps:

sampling the granite stratum; and forming the fracture in the granite stratum, wherein the pressure is set according to the density of the granite stratum.

13. The method for disposing nuclear waste using a deep geological repository of claim 7, wherein the method requires a remote computer-assisted automated control and a robotic operation.

* * * * *